US011688280B2

(12) United States Patent
Wisnewski et al.

(10) Patent No.: US 11,688,280 B2
(45) Date of Patent: Jun. 27, 2023

(54) DYNAMIC TRAFFIC MANAGEMENT SYSTEM

(71) Applicant: Kyndryl, Inc., New York, NY (US)

(72) Inventors: Benjamin Wisnewski, Columbia, MO (US); Thomas E. Reichart, Jefferson City, MO (US); Gregory Wisnewski, Chesterfield, MO (US); Daniel Grey Yates, Columbia, MO (US)

(73) Assignee: Kyndryl, Inc., New York, NY (US)

( * ) Notice: Subject to any disclaimer, the term of this patent is extended or adjusted under 35 U.S.C. 154(b) by 266 days.

(21) Appl. No.: 16/388,252

(22) Filed: Apr. 18, 2019

(65) Prior Publication Data

US 2020/0334982 A1 Oct. 22, 2020

(51) Int. Cl.
*G08G 1/0968* (2006.01)
*G08G 1/01* (2006.01)

(52) U.S. Cl.
CPC ..... *G08G 1/096844* (2013.01); *G08G 1/0108* (2013.01); *G08G 1/0129* (2013.01); *G08G 1/0133* (2013.01); *G08G 1/0145* (2013.01)

(58) Field of Classification Search
CPC ..... G08G 1/096844; G08G 1/0108; G08G 1/0129; G08G 1/0133; G08G 1/0145; G08G 1/0125; G08G 1/0104; B60G 2400/82; B61L 23/048
See application file for complete search history.

(56) References Cited

U.S. PATENT DOCUMENTS

| | | | | |
|---|---|---|---|---|
| 5,289,183 | A | 2/1994 | Hassett et al. | |
| 6,694,247 | B2 | 2/2004 | Hameleers et al. | |
| 9,396,656 | B2 | 7/2016 | Cazanas et al. | |
| 9,940,834 | B1 * | 4/2018 | Konrardy | G08G 1/165 |
| 2007/0135990 | A1 * | 6/2007 | Seymour | G08G 1/081 340/995.13 |
| 2009/0080973 | A1 * | 3/2009 | Bespalov | G08G 1/0129 404/72 |
| 2011/0095908 | A1 | 4/2011 | Nadeem et al. | |
| 2012/0249343 | A1 | 10/2012 | Thomas | |
| 2013/0176424 | A1 | 7/2013 | Weil | |
| 2016/0217226 | A1 * | 7/2016 | Westcott | G06F 9/455 |
| 2017/0115114 | A1 | 4/2017 | Birken et al. | |
| 2017/0314949 | A1 | 11/2017 | Rovik et al. | |
| 2018/0158329 | A1 * | 6/2018 | Benhammou | G08G 1/096716 |
| 2018/0190111 | A1 * | 7/2018 | Green | G06V 20/54 |

(Continued)

OTHER PUBLICATIONS

Balid, W., Tafish, H., & Refai, H. H. (Apr. 2016). Versatile real-time traffic monitoring system using wireless smart sensors networks. In 2016 IEEE Wireless Communications and Networking Conference (pp. 1-6). IEEE. (Year: 2016).*

(Continued)

*Primary Examiner* — Ig T An
*Assistant Examiner* — Stephanie T Su
(74) *Attorney, Agent, or Firm* — George S. Blasiak; Dan Housley; Heslin Rothenberg Farley & Mesiti P.C.

(57) ABSTRACT

Example techniques are described for determining a dynamic traffic-management plan based on factors such as predicted increases in traffic and known-structurally-deficient transportation infrastructure. Traffic patterns may be re-routed, particularly during high-congestion events, to reduce or avoid excessive weight loads travelling across weakened sections of roads, bridges, or the like.

20 Claims, 7 Drawing Sheets

(56) References Cited

U.S. PATENT DOCUMENTS

| | | | | |
|---|---|---|---|---|
| 2019/0051158 | A1* | 2/2019 | Felip Leon | G05D 1/0088 |
| 2020/0292338 | A1* | 9/2020 | Fowe | G08G 1/0141 |

OTHER PUBLICATIONS

Mell et al., "The NIST Definition of Cloud Computing", Special Publication 800-145, Sep. 2011, 7 pgs.
Unknown, "2017 Infrastructure Report Card," https://www.infrastructurereportcard.org/wp-content/uploads/2017/01/Bridges-Final.pdf, accessed Nov. 27, 2019, 4 pgs.
Unknown, "Making the Grade," https://www.infrastructurereportcard.org/making-the-grade/, printed Nov. 27, 2019, 1 pg.

* cited by examiner

DYNAMIC TRAFFIC MANAGEMENT SYSTEM

BACKGROUND

As transportation infrastructure ages, the transportation infrastructure can deteriorate. Such deterioration can impact traffic flow. For example, once a bridge is determined to meet a threshold level of structural deficiency, the bridge may become subject to weight restrictions requiring vehicles to be re-routed and increasing the travel time for re-routed vehicles.

SUMMARY

In one example, the disclosure describes a system including a receiver configured to receive traffic data indicative of a high-traffic event and infrastructure data indicative of transportation infrastructure in a vicinity of the high-traffic event; and processing circuitry configured to determine, based at least in part on the traffic data and the infrastructure data, a traffic management plan for extending a remaining useful lifespan of the transportation infrastructure; and output information indicating the traffic management plan.

In one example, the disclosure describes a method comprising receiving traffic data indicative of a high-traffic event and infrastructure data indicative of transportation infrastructure in a vicinity of the event; determining, based at least in part on the traffic data and the infrastructure data, a traffic management plan for extending a remaining useful lifespan of the transportation infrastructure; and outputting information indicating the traffic management plan.

In one example, the disclosure describes a computer-readable storage medium storing instructions thereon that when executed cause one or more processors to receive traffic data indicative of a high-traffic event and infrastructure data indicative of transportation infrastructure in the vicinity of the event; determine, based at least in part on the traffic data and the infrastructure data, a traffic management plan configured at least in part to extend a remaining useful lifespan of the transportation infrastructure; and output information indicating the traffic management plan.

The details of one or more aspects of the disclosure are set forth in the accompanying drawings and the description below. Other features, objects, and advantages of the disclosure will be apparent from the description and drawings, and from the claims.

DETAILED DESCRIPTION

Current commercial navigation systems, for example, mobile applications such as Google Maps™ or Waze™, allow a user to select from a number of driving routes to one destination, based on different sets of desired criteria. For example, a user may select the shortest-distance route, the fastest route, or the cheapest route (i.e., no tollways). However, there is no navigation system that factors in a state-of-wear of the local transportation infrastructure. Accordingly, reducing a traffic load based on the condition of the infrastructure may increase the relative safety of commuters, as well as extend a remaining useful lifespan of the infrastructure, potentially delaying a need for replacement construction. Hence, the example techniques disclosed herein may provide for example navigation and traffic management systems that are a technical improvement over other types of navigation systems, and for practical applications for such navigation systems.

In general, this disclosure describes systems and methods for managing traffic, particularly with respect to vulnerable transportation infrastructure during significant increases in traffic volume. One example of such a system includes a device configured to receive data indicating a current increase in traffic and/or a predicted future increase in traffic—based on historical records and data analysis, and processing circuitry configured to manage and route the traffic based on user preferences with respect to the condition of transportation infrastructure in the vicinity.

Figure 1:
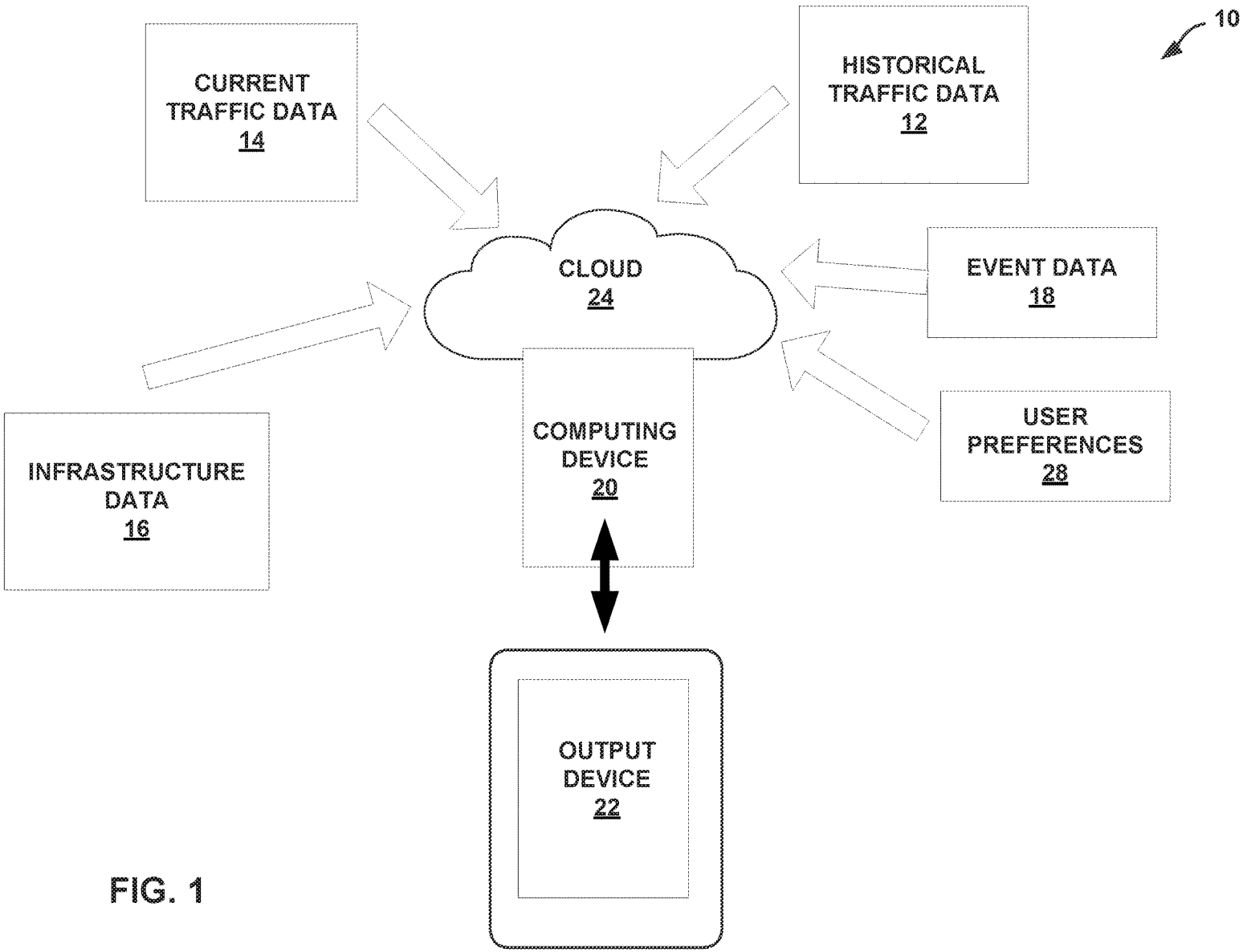
FIG. 1 is a conceptual diagram depicting a traffic management system, in accordance with some examples of this disclosure.

FIG. 1 is a block diagram depicting a traffic management system 10 in accordance with some examples of this disclosure. In some examples, a traffic management system 10 may include a computing device 20, including a memory, processing circuitry, and data transmission/receiving capabilities. In some examples, computing device 20 may be incorporated locally within output device 22. In other examples, computing device 20 may include one or more devices distributed throughout cloud-based computing network 24 (described further with respect to FIGS. 6 and 7, below). It is to be understood that although this disclosure includes a description of cloud computing, implementation of the teachings recited herein are not limited to a cloud-computing environment. Rather, techniques of the present disclosure are capable of being implemented in conjunction with any other type of computing environment now known or later developed. Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service.

Computing device 20 may be configured with software, such as a set of instructions stored within the memory, that when executed by the processor (e.g., processing circuitry), cause the processing circuitry to process data acquired from a plurality of data sources and determine a traffic management plan for reducing the amount of traffic travelling on at least one unit of transportation infrastructure, while otherwise optimizing the overall flow of traffic in a particular geographic region. In some examples, computing device 20 may be a personal computer (PC) or a mobile device, such as a laptop, tablet, or mobile phone. In some examples, computing device 20 may include output device 22, such as a display screen. In other examples, computing device 20 may be configured to transmit a determined traffic management plan to an output device 22 remotely located from the computing device.

In some examples, computing device 20 within traffic management system 10 includes a receiver configured to receive, from a plurality of sources, data that the computing device 20 uses to determine a traffic management plan. For example, computing device 20 may be configured to receive data indicative of a significant increase in an amount of traffic within a particular geographic region. Computing device 20 may receive current data 14 indicative of a current, immediate, or ongoing increase in traffic, and/or historical data 12 indicative of a previous increase in traffic. Computing device 20 may combine historical traffic data 12 with event data 18, indicative of a periodic or repeating high-attendance event for which the historical increase in traffic may be attributable, in order to predict a future increase in traffic corresponding to a future instance of the event. For example, computing device 20 may receive or retrieve event data 18 indicating the occurrence of a weekly sporting event at a local sports stadium and correlate that event data with an observed increase in traffic in the vicinity of the stadium before, during, and after that event, as indicated by historical traffic data 12. The "vicinity" includes a general geographic region surrounding the venue of the high-traffic event. The size of the region that constitutes the "vicinity" may vary depending on the location, size, or type of event. For example, for relatively smaller events, such as a "home" game, the "vicinity" may include the neighborhood of the venue. In other examples including a relatively large event where people travel in great numbers across long distances to attend, the "vicinity" may include the entire city, or in some examples, the entire metropolitan area hosting the event. By correlating data sources 12 and 18, computing device may determine or predict a similar future increase in traffic patterns, for example, according to the competition schedule of the local sports team.

In some examples, computing device 20 may be configured to receive data 16 indicating the presence and physical condition of transportation infrastructure within a designated geographic region. For example, computing device 20 may receive infrastructure data 16 indicative of a bridge or overpass near a sporting stadium that has been designated to be at least some degree of "structurally deficient" by a local or national Department of Transportation or certified team of engineers. In some cases, the bridge or overpass may not currently be subject to weight restrictions but may be have been determined to be at risk of reaching this threshold in the near future due to frequent, high-volume use. Computing device 20 may be configured to determine a traffic management plan, based at least in part on infrastructure data 16 for temporarily reducing (including the example of eliminating) the traffic flowing over at least one unit of infrastructure by outputting a recommendation to route that traffic in a different direction, thereby extending the remaining useful lifespan of the infrastructure unit.

In some examples, traffic management system 10 may include an input device configured to receive data 28 indicative of user preferences, allowing a user to customize the determined traffic management plan based on certain criteria. In some cases, an input device for manual data input, such as user preferences 28, may be the same device as output device 22.

Figure 2:
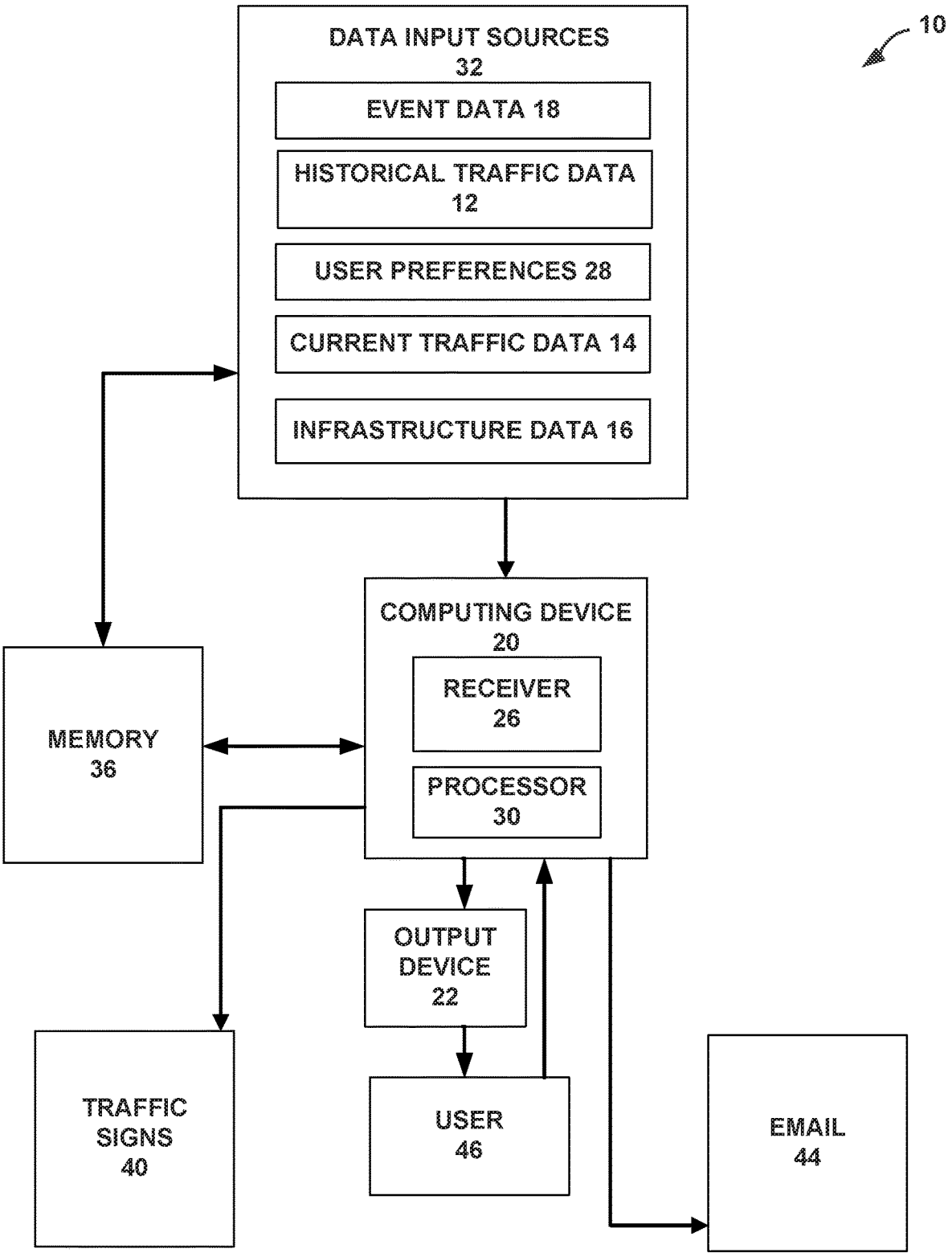
FIG. 2 is a block diagram depicting a traffic management system, in accordance with some examples of this disclosure.

FIG. 2 is a block diagram depicting a traffic management system 10, in accordance with some examples of this disclosure. Traffic management system 10 may include a computing device 20, having processor 30 (or data processing circuitry) and memory 36 configured to execute instructions that cause computing device 20 to determine a traffic management plan for a particular geographic region, based at least in part on data indicating a state-of-wear of transportation infrastructure within that region.

In particular, traffic management system 10 may include computing device 20, configured to determine a traffic management plan that balances the competing interests of reducing traffic flow across weakened or structurally deficient infrastructure and optimizing the local flow of traffic to reduce transportation times for travelers. In some examples, computing device 20 may include processing circuitry or processor 30 located in a cloud-based data-processing and storage center, or alternatively, located within a device that is local to a user 46, such as a mobile device. Processor 30 may be formed as at least one of fixed-function or programmable circuitry. Examples of processing circuitry 30 include microprocessors, application-specific integrated circuits (ASICs), field programmable gate arrays (FPGAs), digital signal processors (DSPs), or other equivalent integrated or discrete logic circuitry.

In some examples, user 46 may input information indicative of a current increase in traffic in a geographic region, and/or a past increase in traffic. The past increase in traffic may be combined with data indicating that the historical traffic increase was due at least in part to a local event, such as a sporting event, convention, or other gathering of people. The event data may indicate that the event, and therefore the traffic increase, is either ongoing or periodic, such as a weekly sporting event or an annual convention. Processing circuitry 30 within traffic management system 10 may accordingly determine that a similar traffic increase will occur at a future date, and may generate a traffic management plan to be implemented on that future date.

In some examples, traffic management system 10 may determine a management plan for a future date based on historical traffic data and event data, and then update the management plan in real-time during that future event while receiving current traffic data. In some examples, traffic management system 10 may receive current traffic data (e.g., in the event that receiver 26 has not received historical traffic data in order for processor 30 to predict future traffic patterns), and may be configured to determine and periodically update a traffic management plan in real-time.

In some examples, user 46 may include a traffic management authority, such as a state government Department of Transportation, or a local law-enforcement agency tasked with managing a flow of traffic. In some examples, user 46 may include a private entity that is hosting or organizing a high-attendance event, and who may be working in conjunction with a traffic management authority to optimize traffic resulting from the event.

Traffic management system 10 may receive data 32 from user 46, and/or instructions from user 46 to retrieve data 32, on which to determine a traffic management plan configured to both maintain a physical condition of local transportation infrastructure as well as maintain a steady flow of traffic wherever possible. Traffic management system 10 may determine a traffic management plan, and then output information indicative of the plan. For example, system 10 may output a visual display, such as a map, to an output device 22. A map may include color-coded indications and/or symbolic icons recommending actions to be taken at various locations on the map so as to reduce or re-route traffic around local transportation infrastructure. Alternatively or additionally, system 10 may output to output device 22 a textual list of recommended traffic management actions to be taken in order to reduce or re-route traffic around local transportation infrastructure, based at least in part on a state-of-wear of the infrastructure.

System 10 may further output instructions indicative of the determined traffic management plan. For example, computing device 20 may be in communication, e.g., wirelessly, with one or more electronic traffic signs 40 along one or more streets. Computing device 20 may be configured to output textual information to the one or more traffic signs 40, for example, instructing motorists to take a detour to avoid upcoming infrastructure. In other examples, computing device 20 may output instructions indicative of the determined traffic management plan in real-time to various traffic management authorities stationed throughout the geographic region. For example, system 10 may output traffic recommendations to email accounts 44 displayed on computers (police-cruiser laptops) or mobile devices held by law-enforcement agencies directing traffic in the vicinity of the local event.

Figure 3:
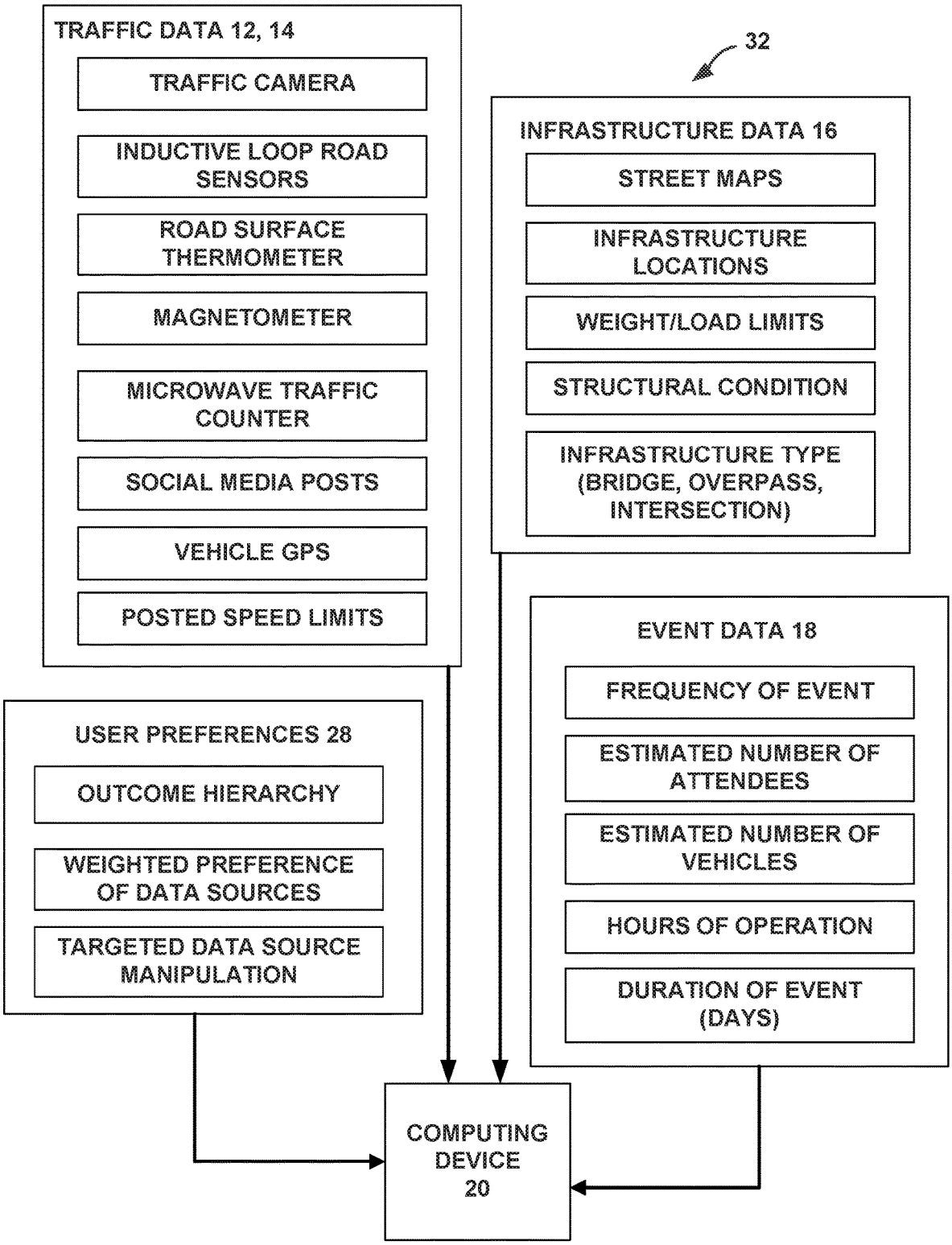
FIG. 3 is a block diagram depicting a traffic management system, in accordance with some examples of this disclosure.

FIG. 3 is a block diagram depicting a traffic management system, in accordance with some examples of this disclosure. More specifically, FIG. 3 depicts a plurality of types of data inputs 32 that a traffic management system may implement as factors to determine and output a traffic management plan. In some examples, computing device 20 may be configured to receive, via user input, or automatically retrieve, data indicative of a flow of traffic within a defined geographical region. In some examples, traffic data may include current, real-time traffic data 14 and/or historical traffic data 12 (collectively, traffic data 12, 14). In some examples, traffic data 12, 14 may include video data from a traffic camera, such as a camera installed at an intersection. Computing device 20 may include pattern-recognition software configured to detect and/or recognize a number or a rate of cars depicted in the video data in order to determine and/or estimate a flow rate of traffic on the street over which the camera is installed.

In some examples, computing device 20 may receive traffic data 12, 14 from one or more sensors, such as sensors embedded within a road, configured to detect a vehicle passing over or near the sensor. For example, traffic sensors may include inductive loop road sensors, road surface thermometers, magnetometers, or microwave traffic counters.

In some examples, computing device 20 may receive or retrieve traffic data 12, 14 from one or more social media or social networking websites or applications. For example, computing device 20 may be configured to detect one or more keywords or geolocation tags associated with a location, such as a street or intersection, as well as keywords indicative of the flow of traffic at that location (e.g., "deadlock", "gridlock", "standstill", etc.). In another example, computing device 20 may be configured to recognize a social media post containing a recommendation not to use a particular route of traffic due to an impedance, such as a pothole, accident, or other traffic disruption.

In some examples, computing device 20 may be configured to receive, via user input, or automatically retrieve, event data 18 indicative of an event or gathering within or near a particular geographic region. For example, computing device 20 may be configured to receive information indicating the occurrence of a past or future sporting event, conference, convention, protest, rally, or other similar gathering of large numbers of people. Computing device 20 may be configured to retrieve further information regarding the event based on user input indicating the event. For example, computing device 20 may receive user input containing the phrase "Super Bowl", causing computing device to retrieve further event data 18, such as from the internet, regarding the event date and time, the event location, an estimated number of attendees based on tickets sold or past attendance, and an estimated number of vehicles based on previous Super Bowl events.

In some examples, computing device may be configured to receive via user input, or retrieve, infrastructure data 16 indicative of the amounts and types of transportation infrastructure within a user-determined vicinity of an event. For example, computing device 20 may receive infrastructure data 16 indicating the locations of all local streets, bridges, overpasses, intersections, and other similar traffic features. Computing device 20 may also receive or retrieve, such as from a Department of Transportation or engineering department, an estimated physical condition or state-of-wear of each identified unit of transportation infrastructure. Computing device 20 may be configured to process this data along with traffic data 12, 14, and event data 18, to determine an estimated increase in traffic flow, load, or weight travelling across the infrastructure attributable to a current or future event or gathering. Computing device 20 may further be configured to determine whether this determined increase in traffic load would be in excess of a determined tolerance or threshold, such as a daily weight limit, for the identified infrastructure units. For example, computing device 20 may be configured to determine, based on historical traffic pattern data 12 and estimated number of event vehicles 18, that the amount of traffic predicted to be traveling over a particular weakened or otherwise structurally deficient overpass would pose a statistically significant threat to the immediate or long-term structural integrity of the overpass. Accordingly, computing device 20 may be configured to determine whether to output a recommendation to reduce the amount of traffic flowing over the overpass at any given time (e.g., by restricting one or more lanes of traffic) or alternatively, to output a recommendation to close access to the overpass entirely. In the latter case, computing device 20 may be configured to determine, based on traffic data 12 and infrastructure data 16, an alternate route or detour through which to reroute traffic around the deficient overpass, so as to otherwise optimize the broader flow of traffic despite the restriction.

In some examples, computing device 20 may be configured to receive or retrieve data from user 46 (FIG. 2) indicative of user preferences 28 by which to customize a determined traffic management plan. For example, computing device 20 may determine that, due to the particular circumstances indicated by traffic data 12, 14, event data 18, and infrastructure data 16, any determined traffic management plan may be significantly likely to either significantly impede traffic or add significant wear to one or more unit of transportation infrastructure. Computing device 20 may be configured to receive preferences 28 from user 46 indicating which of the two outcomes (i.e., increased traffic flow or higher infrastructure protection) is preferred by user 46, given the circumstances.

In some examples, computing device 20 may be configured to receive user preferences 28 indicating a weighed preference, such as a sliding scale or binary option, indicating to which particular sources of data to assign the most "value" to when determining a traffic management plan. For example, computing device 20 may receive user input 28 indicating that magnetometer and microwave traffic counters should be the most-determinative factor regarding whether to re-route heavy traffic indicated by those detectors, whereas traffic camera data and social media data may receive a lower user preference rating. For example, computing device 20 may receive user input 28 indicating that magnetometer data is weighted at a "5", indicating strong user preference, while social media data is weighted at a "1", indicating relatively weak user preference.

In some examples, computing device 20 may be configured to receive user preferences 28 to specifically target a particular data source to manipulate with a traffic management plan. For example, when computing device 20 is configured to receive current, real-time traffic data 14 from a particular sensors, such as a magnetometer, computing device 20 may receive data indicating a user preference 28 to output a traffic management plan specifically determined to reduce the amount of traffic detected by a particular magnetometer (e.g., a magnetometer embedded at or near a unit of weakened infrastructure), or alternatively, to increase the flow rate of traffic detected by a particular magnetometer (e.g., a magnetometer embedded away from weakened infrastructure, or embedded within a preferred detour route). This particular type of user input and user feedback may provide highly accurate, real-time reporting regarding the effectiveness of a particular traffic management plan, allowing a user to determine whether to further customize the plan to further improve traffic goals.

Figure 4:
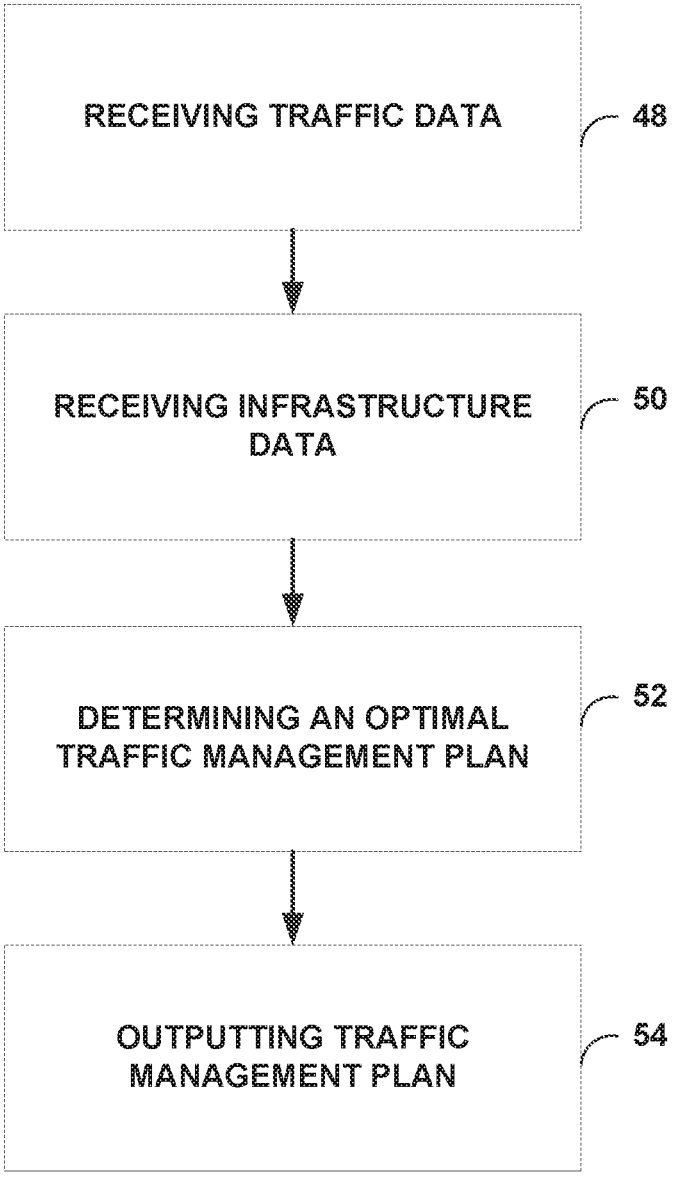
FIG. 4 is a flow diagram depicting a method of managing traffic, in accordance with some examples of this disclosure.

FIG. 4 is a flow diagram depicting a method of managing traffic, in accordance with some examples of this disclosure. A traffic management system including a computing device 20, receives data indicating an amount, rate, and/or distribution of traffic within a particular geographic region (48). Traffic data may include historical traffic data that was recorded during a previous local event or gathering corresponding to a similar event or gathering in the future, whereby the computing device may determine or assume similar traffic patterns at the future date. Alternatively or additionally, traffic data may include current, real-time traffic data from one or more sensors.

The traffic management system, including the computing device, further receives data indicating the location and physical condition of one or more units of transportation infrastructure within or near the same geographic region as indicated by the traffic data (50). Infrastructure data may indicate the presence of one or more "structurally deficient" bridges or overpasses within a determined range of a particularly heavy, or statistically significant increase, in traffic as indicated by the traffic data.

Based on the traffic data and the infrastructure data, computing device 20 may determine a traffic management plan, including a set of recommendations, configured to route traffic away from weakened transportation infrastructure without significantly impeding the flow of traffic in the broader geographic region (52). For example, computing device 20 may be configured to identify a candidate detour route to receive re-routed traffic so as not to trigger major traffic congestion on other routes.

Computing device 20 may further output information indicating the determined traffic management plan to one or more users, such that they may implement the plan (54). For example, computing device 20 may output a textual list of traffic route recommendations and/or a visual representation of the geographic region, displaying icons, symbols, or text overlays indicating the plan's individual recommendations at their corresponding geographic locations. Computing device 20 may also be configured to directly implement the recommended traffic management plan, such as by displaying the routing instructions on electronic traffic management signs along certain roads.

Figure 5:
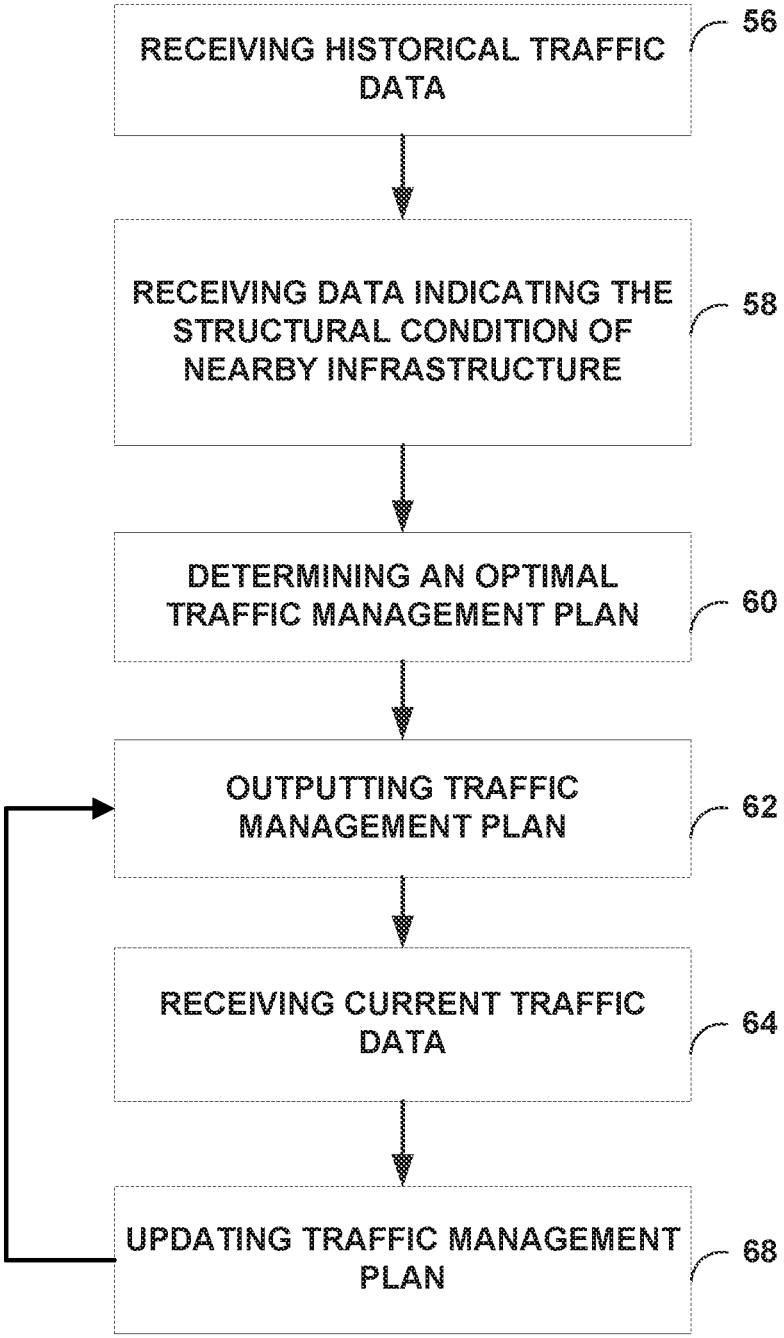
FIG. 5 is a flow diagram depicting a method of managing traffic, in accordance with some examples of this disclosure.

FIG. 5 is a flow diagram depicting a method of managing traffic, in accordance with some examples of this disclosure. A traffic management system including a computing device 20, receives data indicating an amount, rate, and/or distribution of traffic within a particular geographic region (56). Traffic data may include historical traffic data that was recorded during a previous local event or gathering, corresponding to a similar event or gathering in the future, whereby the computing device may determine or assume similar traffic patterns at the future date.

The traffic management system, including the computing device, further receives data indicating the location and physical condition of one or more units of transportation infrastructure within or near the same geographic region as indicated by the traffic data (58). Infrastructure data may indicate the presence of one or more "structurally deficient" bridges or overpasses within a determined range of a particularly heavy, or statistically significant increase, in traffic as indicated by the traffic data.

Based on the traffic data and the infrastructure data, computing device 20 may determine a traffic management plan, including a set of recommendations, configured to route traffic away from weakened transportation infrastructure without significantly impeding the flow of traffic in the broader geographic region (60). For example, computing device 20 may be configured to identify a candidate detour route to receive re-routed traffic so as not to trigger major traffic congestion on other routes.

Computing device 20 may further output information indicating the determined traffic management plan to one or more users, such that they may implement the plan (62). For example, computing device 20 may output a textual list of traffic route recommendations and/or a visual representation of the geographic region, displaying icons, symbols, or text overlays indicating the plan's individual recommendations at their corresponding geographic locations. Computing device 20 may also be configured to directly implement the recommended traffic management plan, such as by displaying the routing instructions on electronic traffic management signs along certain roads.

The traffic management system, including computing device 20, may be configured to update the implemented traffic management plan by receiving current or real-time traffic data from one or more sensors (64). In this respect, the traffic management plan may be considered "dynamic." For example, computing device 20 may receive traffic sensor data indicating whether a particular traffic management plan recommendation is causing excessive delays along a particular street on which traffic had been detoured. Computing device uses current traffic data to determine an updated traffic management plan to address the real-time traffic flow issues (68). Traffic management system may output this updated traffic management plan similar to the original traffic plan (62), and await new traffic data so as to repeat the previous two steps until overall traffic subsides or the traffic management system receives a termination command from a user.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows. In examples of on-demand self-service, a cloud consumer can unilaterally provision computing capabilities, such as server time and network storage, as needed automatically without requiring human interaction with the service's provider.

In examples of road network access, capabilities are available over a network and accessed through standard mechanisms that promote use by heterogeneous thin or thick client platforms (e.g., mobile phones, laptops, and PDAs).

In examples of resource pooling, the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

In examples of rapid elasticity, capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

In examples of a measured service, cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows. In examples of Software as a Service (SaaS), the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

In examples of Platform as a Service (PaaS), the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

In examples of Infrastructure as a Service (IaaS), the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows. In examples of a private cloud, the cloud infrastructure is operated solely for an organization. It may be managed by the organization or a third party and may exist on-premises or off-premises.

In examples of a community cloud, the cloud infrastructure is shared by several organizations and supports a specific community that has shared concerns (e.g., mission, security requirements, policy, and compliance considerations). It may be managed by the organizations or a third party and may exist on-premises or off-premises.

In examples of a public cloud, the cloud infrastructure is made available to the general public or a large industry group and is owned by an organization selling cloud services.

In examples of a hybrid cloud, the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service-oriented with a focus on statelessness, low coupling, modularity, and semantic interoperability. At the heart of cloud computing is an infrastructure that includes a network of interconnected nodes.

Figure 6:
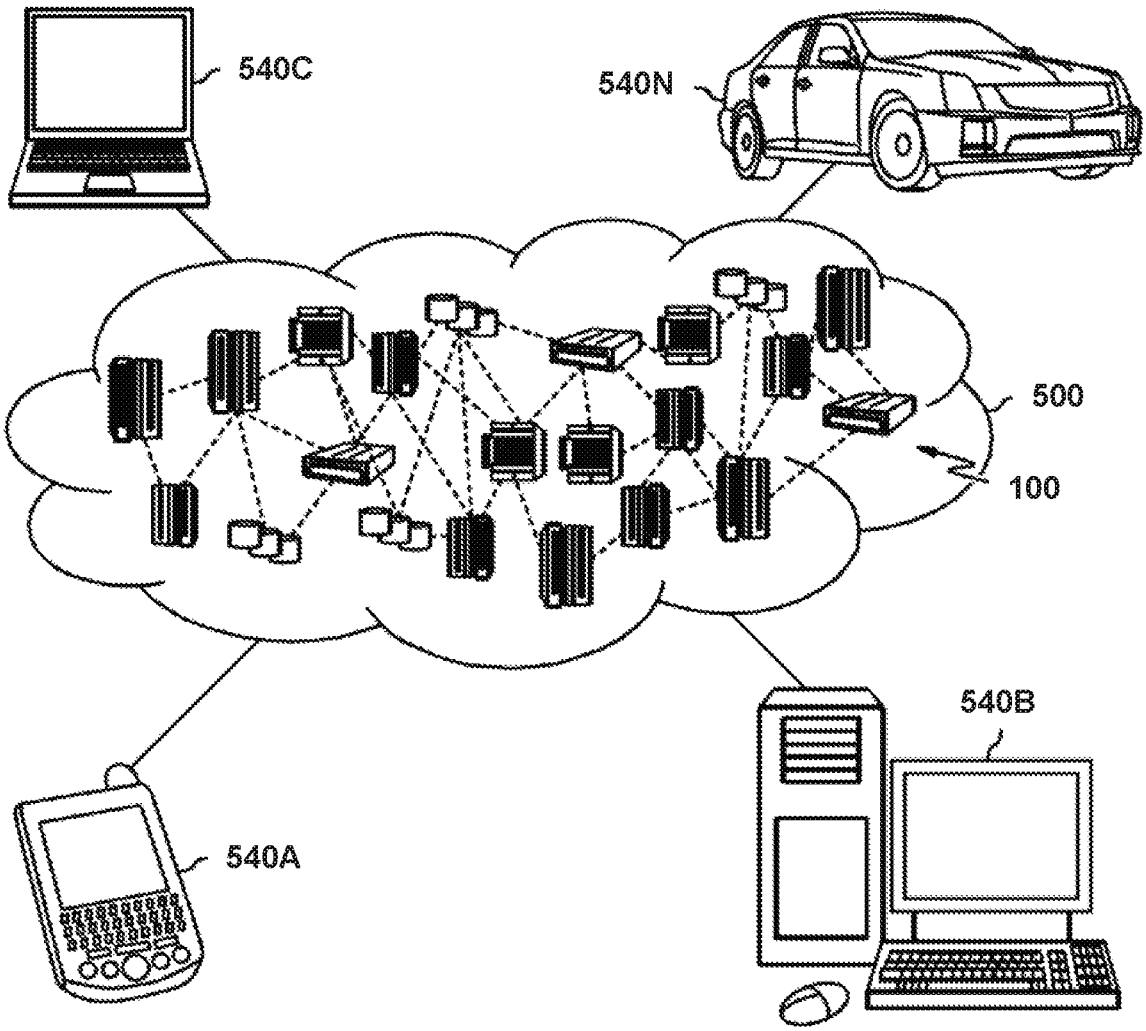
FIG. 6 depicts a cloud computing environment according to some examples of this disclosure.

Referring now to FIG. 6, illustrative cloud computing environment 500 is depicted. Cloud computing environment may be an example of cloud-based computing network 24 (FIG. 1). As shown, cloud computing environment 500 includes one or more cloud computing nodes 100 (in some examples, computing device 20 of FIG. 1) with which local computing devices used by cloud consumers (for example, output device 22 of FIG. 1), such as personal digital assistant (PDA) or cellular telephone 540A, desktop computer 540B, laptop computer 540C, and/or automobile computer system 540N, may communicate. Nodes 100 may communicate with one another. They may be grouped (not shown) physically or virtually, in one or more networks, such as Private, Community, Public, or Hybrid clouds as described hereinabove, or a combination thereof. This allows cloud computing environment 500 to offer infrastructure, platforms and/or software as services for which a cloud consumer does not need to maintain resources on a local computing device. It is understood that the types of computing devices 540A-N shown in FIG. 6 are intended to be illustrative only and that computing nodes 100 and cloud computing environment 500 can communicate with any type of computerized device over any type of network and/or network addressable connection (e.g., using a web browser).

Figure 7:
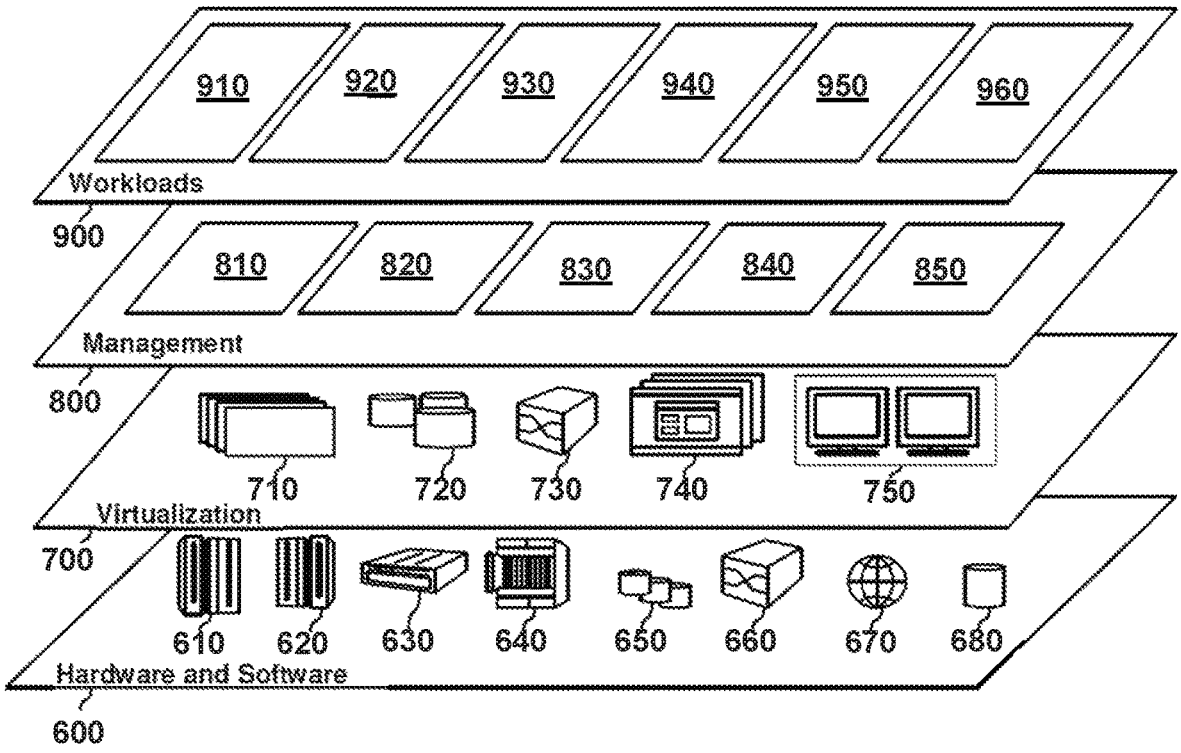
FIG. 7 depicts abstraction model layers according to some examples of this disclosure.

Referring now to FIG. 7, a set of functional abstraction layers provided by cloud computing environment 500 (FIG. 6) is shown. It should be understood in advance that the components, layers, and functions shown in FIG. 7 are intended to be illustrative only and embodiments of the invention are not limited thereto. As depicted, the following layers and corresponding functions are provided.

Hardware and software layer 600 includes hardware and software components. Examples of hardware components include mainframes 610, RISC (Reduced Instruction Set Computer) architecture-based servers 620, servers 630, blade servers 640, storage devices 650, and networks and networking components 660. In some embodiments, software components include network application server software 670 and database software 680.

Virtualization layer 700 provides an abstraction layer from which the following examples of virtual entities may be provided: virtual servers 710, virtual storage 720, virtual networks 730, including virtual private networks, virtual applications and operating systems 740, and virtual clients 750.

In one example, management layer 800 may provide the functions described below. Resource provisioning 810 provides dynamic procurement of computing resources and other resources that are utilized to perform tasks within the cloud computing environment. Metering and Pricing 820 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 830 provides access to the cloud computing environment for consumers and system administrators. Service level management 840 provides cloud computing resource allocation and management such that required service levels are met. Service Level Agreement (SLA) planning and fulfillment 850 provide pre-arrangement for, and procurement of, cloud computing resources for which a future requirement is anticipated in accordance with an SLA.

Workloads layer 900 provides examples of functionality for which the cloud computing environment may be utilized. Examples of workloads and functions which may be provided from this layer include mapping and navigation 910, software development and lifecycle management 920, virtual classroom education delivery 930, data analytics processing 940, transaction processing 950, and traffic management system 960.

Traffic management system 960 may include traffic management system 10 (FIG. 1), configured to receive traffic data indicative of a high-traffic event and infrastructure data indicative of transportation infrastructure in a vicinity of the high-traffic event, and determine, based at least in part on the traffic data and the infrastructure data, a traffic management plan for extending a remaining useful lifespan of the transportation infrastructure, and output information indicating the traffic management plan.

The example techniques described in this disclosure may be implemented by a computing device, a method, and/or a computer program product. The computer program product may include a computer readable storage medium (or media) having computer readable program instructions thereon for causing a processor to carry out aspects of one or more examples described in this disclosure.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present disclosure may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some examples, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of one or more examples described in this disclosure.

Aspects of the disclosure are described herein with reference to flowchart illustrations and/or block diagrams of methods, apparatus (systems), and computer program products according to one or more examples. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the figures illustrate the architecture, functionality, and operation of possible implementations of systems, methods, and computer program products according to various examples of this disclosure. In this regard, each block in the flowchart or block diagrams may represent a module, segment, or portion of instructions, which comprises one or more executable instructions for implementing the specified logical function (s). In some implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The description of the present disclosure has been presented for purposes of illustration and description and is not intended to be exhaustive or limited to the disclosure in the form disclosed. Many modifications and variations will be understood by persons of ordinary skill in the art based on the concepts disclosed herein. The particular examples described were chosen and disclosed in order to explain the techniques described in the disclosure and example practical applications, and to enable others of ordinary skill in the art to understand the disclosure for various examples with various modifications as are suited to the particular use contemplated. The various examples described herein are within the scope of the following claims.

What is claimed is:

1. A method comprising:

receiving historical traffic data for a set of roads and infrastructure data specifying structural condition and state of wear of a plurality of bridge structure infrastructure units disposed within the set of roads;

predicting using the historical traffic data that a high traffic event will occur at a specified location within the set of roads;

responsive to the predicting that that the high traffic event will occur at a specified location within the set of roads, determining whether respective ones of the plurality of bridge structure infrastructure units disposed within the set of roads are within a vicinity of the specified location within the set of roads;

identifying from the determining first and second bridge structure transportation infrastructure units as being within the vicinity of the specified location within the set of roads, wherein a weight limit over specified time has been ascertained for the first and second bridge structure transportation infrastructure units using the infrastructure data specifying the structural condition and state of wear for the first and second bridge structure infrastructure units; and controlling traffic over the set of roads so that, at a time of the high traffic event, traffic is reduced over the first and second bridge structure transportation infrastructure units in order to satisfy the weight limit over specified time ascertained for the first and second bridge structure transportation infrastructure units using the infrastructure data specifying the structural condition and state of wear for the first and second bridge structure infrastructure units.

2. The method of claim 1, wherein the controlling includes controlling electronic signs along the set of roads to reduce the traffic across the first and second bridge structure transportation infrastructure units.

3. The method of claim 1, wherein the controlling includes controlling electronic signs along the set of roads to reduce the traffic across the first and second bridge structure transportation infrastructure units, and wherein the infrastructure data specifying the structural condition and state of wear for the first and second bridge structure infrastructure units has been provided by a certified engineering authority.

4. The method of claim 1, wherein the controlling includes controlling electronic signs along the set of roads.

5. The method of claim 1, wherein the infrastructure data specifying the structural condition and state of wear for the first and second bridge structure infrastructure units has been provided by a certified engineering authority.

6. The method of claim 1, wherein the traffic data comprises video data from at least one traffic camera.

7. The method of claim 1, wherein the traffic data comprises road-embedded weight sensor data.

8. A system comprising:

a receiver configured for receiving historical traffic data for a set of roads and infrastructure data specifying structural condition and state of wear of a plurality of bridge structure infrastructure units disposed within the set of roads; and processing circuitry configured for:

predicting using the historical traffic data that a high traffic event will occur at a specified location within the set of roads;

responsive to the predicting that that the high traffic event will occur at a specified location within the set of roads, determining whether respective ones of the plurality of bridge structure infrastructure units disposed within the set of roads are within a vicinity of the specified location within the set of roads;

identifying from the determining first and second bridge structure transportation infrastructure units as being within the vicinity of the specified location within the set of roads, wherein a weight limit over specified time has been ascertained for the first and second bridge structure transportation infrastructure units using the infrastructure data specifying the structural condition and state of wear for the first and second bridge structure infrastructure units; and controlling traffic over the set of roads so that, at a time of the high traffic event, traffic is reduced over the first and second bridge structure transportation infrastructure units in order to satisfy the weight limit over specified time ascertained for the first and second bridge structure transportation infrastructure units using the infrastructure data specifying the structural condition and state of wear for the first and second bridge structure infrastructure units.

9. The system of claim 8, wherein the controlling includes controlling electronic signs along the set of roads to reduce the traffic across the first and second bridge structure transportation infrastructure units.

10. The system of claim 8, wherein the controlling includes controlling electronic signs along the set of roads to reduce the traffic across the first and second bridge structure transportation infrastructure units, and wherein the infrastructure data specifying the structural condition and state of wear for the first and second bridge structure infrastructure units has been provided by a certified engineering authority.

11. The system of claim 8, wherein the controlling includes controlling electronic signs along the set of roads.

12. The system of claim 8, wherein the infrastructure data specifying the structural condition and state of wear for the first and second bridge structure infrastructure units has been provided by a certified engineering authority.

13. The system of claim 8, wherein the traffic data comprises video data from at least one traffic camera.

14. The system of claim 8, wherein the traffic data comprises road-embedded weight sensor data.

15. A computer program product comprising a computer-readable storage medium storing instructions thereon that when executed cause one or more processors to perform the method comprising:

receiving historical traffic data for a set of roads and infrastructure data specifying structural condition and state of wear of a plurality of bridge structure infrastructure units disposed within the set of roads;

predicting using the historical traffic data that a high traffic event will occur at a specified location within the set of roads;

responsive to the predicting that that the high traffic event will occur at a specified location within the set of roads, determining whether respective ones of the plurality of bridge structure infrastructure units disposed within the set of roads are within a vicinity of the specified location within the set of roads;

identifying from the determining first and second bridge structure transportation infrastructure units as being within the vicinity of the specified location within the set of roads, wherein a weight limit over specified time has been ascertained for the first and second bridge structure transportation infrastructure units using the infrastructure data specifying the structural condition and state of wear for the first and second bridge structure infrastructure units; and controlling traffic over the set of roads so that, at a time of the high traffic event, traffic is reduced over the first and second bridge structure transportation infrastructure units in order to satisfy the weight limit over specified time ascertained for the first and second bridge structure transportation infrastructure units using the infrastructure data specifying the structural condition and state of wear for the first and second bridge structure infrastructure units.

16. The computer program product of claim 15, wherein the controlling includes controlling electronic signs along the set of roads to reduce the traffic across the first and second bridge structure transportation infrastructure units.

17. The computer program product of claim 15, wherein the controlling includes controlling electronic signs along the set of roads to reduce the traffic across the first and second bridge structure transportation infrastructure units, and wherein the infrastructure data specifying the structural condition and state of wear for the first and second bridge structure infrastructure units has been provided by a certified engineering authority.

18. The computer program product of claim 15, wherein the controlling includes controlling electronic signs along the set of roads.

19. The computer program product of claim 15, wherein the traffic data comprises video data from at least one traffic camera.

20. The computer program product of claim 15, wherein the traffic data comprises road-embedded weight sensor data.

* * * * *